United States Patent [19]

Owens

[11] Patent Number: 4,799,036

[45] Date of Patent: Jan. 17, 1989

[54] RADIO FREQUENCY COAXIAL FEEDTHROUGH

[75] Inventor: Thomas L. Owens, Kingston, Tenn.

[73] Assignee: The United States of America as represented by the Department of Energy, Washington, D.C.

[21] Appl. No.: 129,209

[22] Filed: Dec. 7, 1987

[51] Int. Cl.[4] ..... H01P 1/08; H01P 5/00

[52] U.S. Cl. ..... 333/260; 333/252; 174/28

[58] Field of Search ..... 333/244, 245, 252, 260; 174/28

[56] References Cited

U.S. PATENT DOCUMENTS

| | | | |
|---|---|---|---|
| 2,786,185 | 3/1957 | Sege et al. | 333/252 |
| 3,058,074 | 10/1962 | Kane | 333/245 |
| 3,156,881 | 11/1964 | Bondley | 333/252 |
| 3,439,296 | 4/1969 | Buckley | 333/252 |

*Primary Examiner*—Paul Gensler

*Attorney, Agent, or Firm*—David E. Breeden; Stephen D. Hamel; Judson R. Hightower

[57] ABSTRACT

An improved radio frequency coaxial transmission line vacuum feed-through is provided based on the use of a half-wavelength annular dielectric pressure barrier disk, or multiple disks comprising an effective half wavelength structure to eliminate reflections from the barrier surfaces. Gas-tight seals are formed about the outer and inner diameter surfaces of the barrier disk using a sealing technique which generates radial forces sufficient to form seals by forcing the conductor walls against the surfaces of the barrier disks in a manner which does not deform the radii of the inner and outer conductors, thereby preventing enhancement of the electric field at the barrier faces which limits voltage and power handling capabilities of a feedthrough.

5 Claims, 2 Drawing Sheets

RADIO FREQUENCY COAXIAL FEEDTHROUGH

BACKGROUND OF THE INVENTION

This invention, which is a result of a contract with the United States Department of Energy, relates generally to radio frequency feedthrough devices for separating regions of different pressure along a coaxial transmission line and more specifically to improvements in coaxial feedthroughs utilizing single or multiple dielectric barriers whose overall electrical lengths are effectively a half-wavelength.

Pressure barriers are used extensively in coaxial transmission lines where it is necessary to transmit radio frequency (RF) energy from one region of the line which is operated at a substantially different pressure from that of a second region of the line. Usually one region of the line is evacuated; thus, the term vacuum feedthrough is used when referring to these devices. Some of the major problems encountered with vacuum feedthroughs is the introduction of reflections of the RF energy at the barrier interfaces and undesirable enhancement of the wave electric field in the vicinity of the barrier faces which lowers the power handling capability compared to that of a uniform transmission line. These problems are especially difficult to overcome in devices used for transmission at high frequencies and high power levels at elevated temperatures where structural integrity is a problem with materials such as ceramics which must be used to form the barriers.

In the art of vacuum feedthrough design for high power, coaxial transmission lines, various means have been proposed for mounting the ceramic barrier material, such as alumina, to provide sufficient structural support for the ceramic barrier while trying to minimizing reflections and electric field enhancement. These designs normally employ either cylindrical or conical shaped ceramic barriers mounted between inner and outer tapered sections of the coaxial conductors to take advantage of the inherent structural qualities of these geometries. Examples of thses types of feedthroughs are disclosed in U.S. Pat. No. 4,694,264 issued Sept. 15, 1987 to Thomas L. Owens et al for a "Radio Frequency Coaxial Feedthrough Device" and U.S. Pat. No. 4,484,019 issued Nov. 20, 1984 to Glenn F. Gratz for a "High voltage RF Feedthrough Bushing". In these devices, the inner and outer conductor surfaces are tapered and/or shaped in the vicinity of the barrier to attempt to provide a uniform impedance along the barrier section to reduce reflections caused by the presence of the dielectric barrier. However, these abrupt changes in the radii and shapes of the conductors increases the electric field at the barrier faces over that of a uniform transmission line, thereby lowering the feedthrough power handling potential.

Other attempts to form barriers in coaxial transmission lines using annular ceramic disks disposed transverse to the longitudinal axis of the line have been unsuccessful primarily due to the same problems of reflections and electric field enhancement due to the mounting arrangements for vacuum sealing. Although, reflections may be minimized by using half-wavelength thick dielectric disks or separate disks spaced to cancel reflections produced by each other in a half-wavelength phase displacement arrangement, the electric field enhancement problems still exists and is a limiting factor for high frequency, high power transmission applications.

Thus, there is a need for an RF energy transmission line feedthrough which does not limit the transmission characteristics of the line in which it is to be used.

SUMMARY OF THE INVENTION

In view of the above need it is an object of this invention to provide an RF energy feedthrough for a coaxial transmission line which goes not limit the transmission characteristics of the line in which it is installed.

Further, it is an object of this invention to provide an RF energy feedthrough as in the above object in which the pressure barrier may be sealed without introducing distortions in the coaxial conductors which would produce undesirable electric field enhancements.

Other objects and many of the attendant advantages of the present invention will be apparent from the following detailed description taken in conjunction with the accompanying drawings.

Briefly, the RF energy feedthrough for a coaxial transmission line according to the present invention includes a coaxial transmission line segment having an inner cylindrical conductor, an outer cylindrical conductor coaxially disposed about and spaced from the inner conductor, at least one annular barrier disk formed of a rigid, impermeable, electrically insulating material coaxially disposed between and contiguous with the inner and outer conductors, and at least one radial force generating gas tight sealing means for generating-radial sealing forces of the outer and inner conductors against the barrier disk. The sealing means includes a radially inward force transmitting outer collar disposed about and contiguous with the outer conductor in axial alignment with the barrier disk and adapted to receive an outer sleeve in a press fit arrangement thereabout to generate the radially inward sealing force of the outer conductor against the outer diameter surface of the barrier disk. A radially outward force transmitting inner collar is disposed within and contiguous with the inner conductor in axial alignment with the barrier disk and adapted to receive a plug in a press fit arrangement therein to generate the radial outward sealing force of the inner conductor against the inner diameter surface of the barrier disk, so that the barrier disk is sealed into place in a gas-tight sealing arrangement between the outer and inner conductors.

The radial force transmitting collars are formed slightly narrower in axial thickness than the barrier disk so that the sealing forces applied about the inner and outer diameter surfaces of the barrier disk do not produce distortions in the inner and outer conductor radii that would produce undesirable electric field enhancements of the transmitted waves at the barrier faces.

In one embodiment of the feedthrough according to the present invention, a single barrier disk is employed which is one-half wavelength in thickness for the material forming the barrier disk.

In the preferred embodiment, a pair of barrier disks are inserted in the line, each having a thickness much less than a half-wavelength of the operating frequency waves in the barrier material and spaced apart axially along the transmission segment such that the phase shift of the transmitted waves are shifted one-half wavelength through the region of the barrier disks, thereby eliminating reflections by cancellation of the reflected waves from one barrier by that of the other barrier.

DETAILED DESCRIPTION

Figure 1:
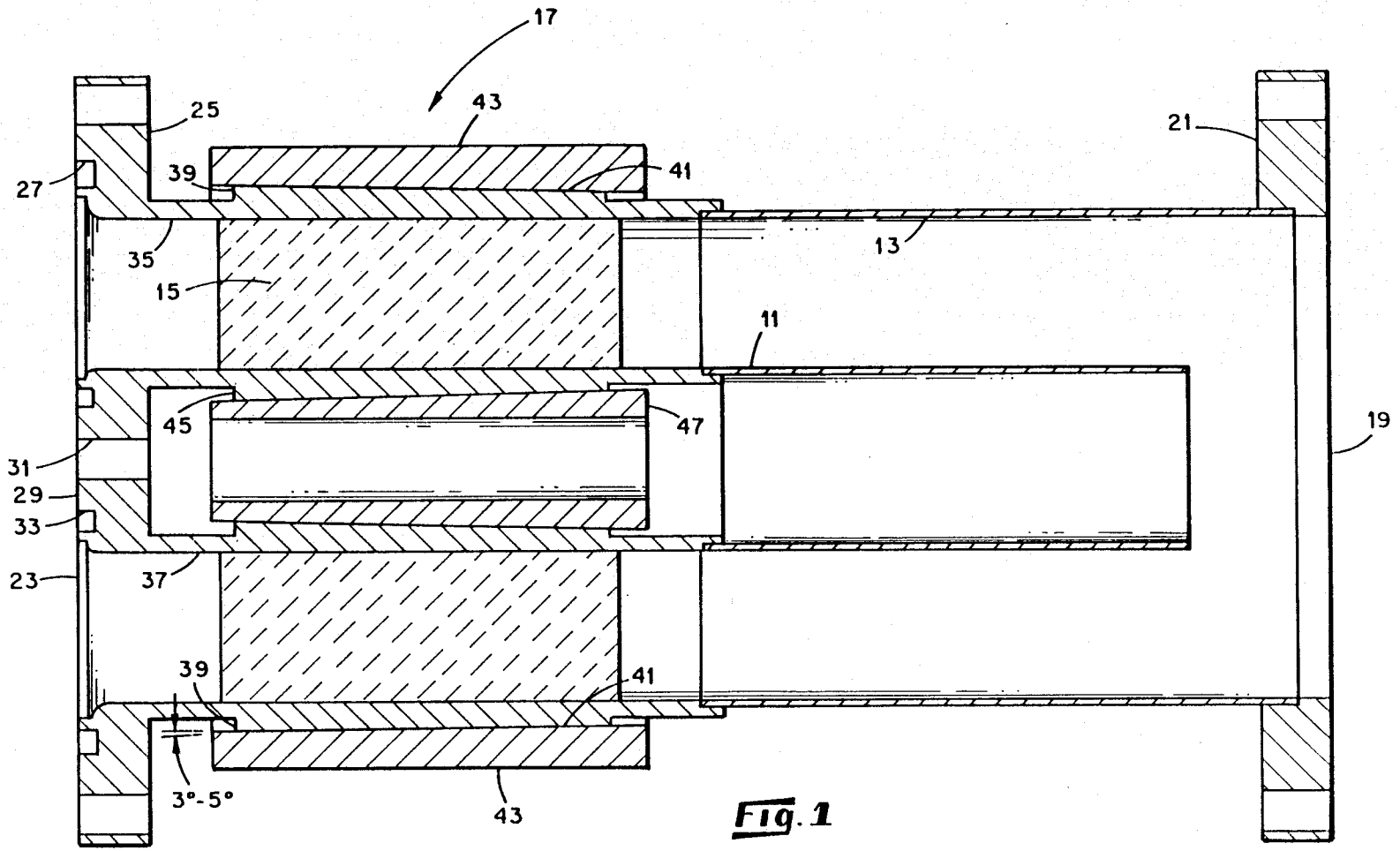
FIG. 1 is a cross-sectional view of one embodiment of a vacuum feedthrough for a coaxial transmission line according to the present invention wherein the vacuum barrier is formed of a single disk of dielectric material having a thickness of one-half wavelength.

Referring now to FIG. 1, there is shown one embodiment of a vacuum feedthrough coaxial segment according to the present invention which employs a single vacuum barrier dielectric for connection in a coaxial transmission line between an evacuated area of the line and an area of the line operated at a higher pressure. The coaxial feedthrough comprises an inner cylindrical conductor 11, an outer coaxial conductor 13, an annular insulator vacuum barrier disk 15 formed of a gas impermeable ceramic dielectric material, such as alumina or beryllia, and a radial sealing force generating arrangement 17 for providing a gas-tight seal between the barrier disk 15 and the inner and outer conductive walls. The feedthrough may be connected at one end 19 to a gas-filled high voltage coaxial transmission line, or other suitable source of high voltage RF power, by means of a conventional coupling flange 21, while the other end 23 is connected to an evacuated coaxial line or RF power utilization device, such as an antenna disposed in a vacuum environment. The evacuated end 23 is coupled to the evacuated coaxial line by means of a vacuum-tight sealing outer conductor flange 25 and an inner conductor coupling 29. The flange 25 forms a portion of the outer conductor 13 and is provided with a circular groove 27 formed in the mating surface for receiving an sealing member in a conventional vacuum sealing arrangement. The coupling 29 forms a portion of the inner conductor which may be bolted to a similar coupling of the connecting line through a central access opening 31. The coupling is also provided with a circular groove 33 for receiving a sealing member as in the outer flange 25.

The flange 25 and inner coupling 29 are formed of the same material as the inner and outer conductors, which is preferably copper. Both the flange 25 and coupling 29 each have axially extending cylindrical extension portions 35 and 37, respectively, forming corresponding reinforced lengths of the outer and inner conductors 13 and 11, respectively. The axially extending portions 35 and 37 extend beyond the area of the location of the barrier disk 15 and are capable of withstanding the axially applied mechanical forces to form the vacuum seals, as will be explained hereinbelow. The inner 11 and outer 13 conductors, which are preferably formed of copper tubing, are connected to the conductor extensions 37 and 35, respectively, to form continuous smooth walls forming the coaxial transmission line segment. The barrier disk 15 acts as a strong structural spacing member holding the conductors in the proper spaced relationship. The inner and outer diameter surfaces of the barrier disk are machined and polished to provide a smooth contiguous fit between the inner and outer conductors prior to being sealed into position by the radial force generating sealing arrangement, as will now be described.

In order to prevent cracking of the ceramic material forming the barrier disk 15, the disk is maintained in compression during assembly of applying an outer, radially inward sealing force of the outer conductor wall against the outer diameter surface of the disk prior to applying an inner, radially outward sealing force of the inner conductor wall against the inner diameter surface of the disk. To provide the outer radial sealing force, the disk 15 is aligned with a radial force transmitting collar 39 disposed about and contiguous with the outer surface of the outer conductor 13 in the reinforced extension region 35. The collar 39 is preferably formed as an integral part of the flange extension 35. However, it may be installed as a separate ring which is slipped over the conductor extension 35 in a tight-fitting arrangement. In either case, the outer surface 41 is machined with a small angle taper (typically 3–5 degrees) towards the opposite end of the feedthrough from the flange 25. A sleeve 43 having a taper on the inner surface matching that of the collar 39 is forced axially into position about the collar 39, as shown in FIG. 1. The sleeve is formed of a material having a coefficient of expansion equal to or less than that of the barrier disk 15 ceramic material. The sleeve is designed to be forced onto the radial force transmitting collar with a force that may exceed 5 tons total force, thereby producing a radial force of the outer conductor wall against the outer diameter surface of the barrier disk in excess of 50,000 lbs/in$^2$.

Once the outer sealing force is applied, the inner surface of the disk 15 is sealed against the walls of the inner conductor 11 in the same manner through the use of a radial force transmitting collar 45 and a mating plug 47. The plug is forced into position against the collar 45 to exert the radially outward sealing force against the inner diameter surface of the barrier disk 15. By installing the outer sleeve 43 prior to installing the inner plug 47, the ceramic disk 15 is maintained in compression so that very high radial sealing forces (greater than 100,000 lbs/in$^2$) may be applied without damaging the ceramic when squeezing the copper conductor walls against the ceramic. The reinforced portions 35 and 37 of of the conductors prevent buckling of the conductors when the sleeve 43 and plug 47 are pressed into place over the respective radial force transmitting collars. To complete the feedthrough segment, the flange 21 is installed onto the opposite end of the outer conductor tube 13 as by electrical soldering of the tube to the flange, as shown, to form a smooth outer conductor wall.

When alumina is used as the barrier disk 15, the sleeve 43 may be formed of materials such as stainless steel, case hardened steel, molybdenum, or niobium, all of which have a coefficient of expansion comparable to or less than that of alumina. Somewhat higher operating temperature capability for high power applications could be expected for the above sealing arrangement if the outer sleeve 43 is made of molybdenum which has a typical coefficient for thermal expansion of 4.9/° C. This is less than that of alumina, which is approximately 6.5/° C., so that as the feedthrough heats up the inward radial force at the outer sealing surface of the barrier increases which holds the copper conductor walls against the ceramic and tightens the seal. Without the molybdenum sleeve the copper tube, having a coefficient of expansion of 16/° C., would expand away from the ceramic as the feedthrough heats up, opening the seal.

The plug 47 is formed of a material, such as niobium, or stainless steel, which has a coefficient of expansion comparable to or slightly greater than that of alumina. This prevents the inner conductor extension portion 37 from shrinking faster than the alumina when the feedthrough cools after being heated, thereby maintaining the seal.

In order to prevent deformation of the copper in the seal areas about the barrier disk 15 inner and outer diameter surface edges, the radial force transmitting collars 39 and 45 are made slightly thinner (an amount approximately twice the conductor wall thickness at the barrier location) in axial width than the thickness of the barrier disk 15. This prevents the formation of a sharp edge in the inner and outer conductor walls at the barrier faces caused by slightly changes in the conductor diameters if the radial sealing forces overlap the barrier 15 edges. Any abrupt change in conductor radius at the barrier interfaces produces unwanted enhancement of the electric field, thereby reducing the operating voltage and power handling limits of the feedthrough. It has been found that by applying the radial sealing forces uniformly over the inner and outer diameter surfaces of the barrier disk, short of the edges, the inner and outer conductor radii over the length of the feedthrough are maintained constant and the electric field at the dielectric barrier 15 faces are the same as the field for a uniform transmission line without the dielectric vacuum barrier. Test have shown that a 50 ohm feedthrough having an inner conductor radius of 3.340 cm and an outer conductor radius of 7.689 cm and sealed in the above described manner may be operated at a voltage of 7,500 volts without voltage breakdown at power transmission levels up to at least 575,000 watts into a 50 ohm load at a frequency of 425 megahertz (MHz) at atmospheric pressure in the pressurized region of the feedthrough with modest pressurization (2 atmospheres gauge of dry nitrogen). Voltages capability greater than 30,000 volts has been demonstrated at 25 MHz.

In the embodiment shown in FIG. 1, the barrier disk 15 must be machined to an axial length, or thickness, close to one-half wavelenth of the operating frequency wave length in the medium forming the barrier to eliminate reflections at the barrier interfaces. For a transmitting frequency of 425 (MHz), the barrier disk 15 thickness using alumina having a dielectric constant of 8.5 for one-half wavelength would be 12.1 cm. It has been found that the variation of VSWR (voltage standing wave ratio) with dielectric thickness close to the half-wavelength is small enough to allow a reasonable margin for error in the ceramic thickness. For example, a ceramic thickness using alumina of between 11.8 and 12.4 for the above operating parameters will still maintain the VSWR below 1.22:1.

Figure 2:
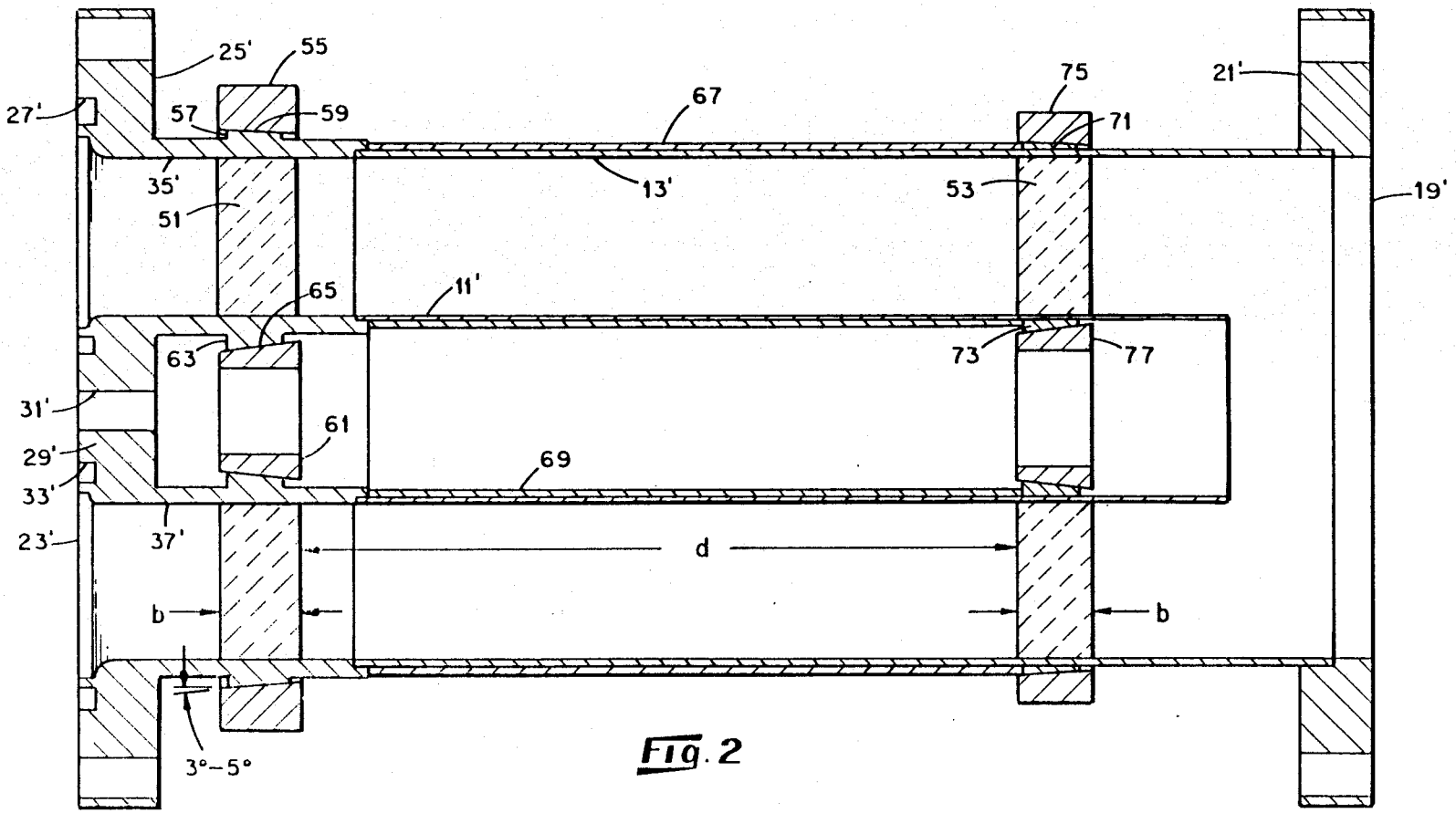
FIG. 2 is a cross-sectional view of a second embodiment of a vacuum feedthrough according to the present invention wherein the barrier is formed of a pair of disks of dielectric material appropriately spaced axially to eliminate reflections.

Although the single half-wavelength barrier feedthrough, as shown in FIG. 1, has greater mechanical strength, a split dielectric feedthrough, as shown in FIG. 2, is preferred. This feedthrough is lighter in weight and is easier to tune to the operating frequency. The structure is similar to the structure of the feedthrough of FIG. 1 and similar parts are identified by like primed reference numerals. In this embodiment, the single thick barrier disk is replaced by two dielectric barriers 51 and 53 which are much thinner in total thickness than the single barrier and are spaced apart axially along the coaxial transmission line segment forming the feedthrough a distance such that the total phase angle corresponding to the length of transmission line between dielectric barriers 51 and 53, distance (d), plus the thickness of the barriers (*2b*) is equivalent to one-half wavelength of the transmitted waves in the combined mediums. This spacing, assuming the thickness of the barriers 51 and 53 are considerably less than a half-wavelength in thickness for the material of the barriers, tunes the feedthrough such that reflections are eliminated by cancellation of reflections from each other as explained above.

The feedthrough is tuned by connecting a terminating load having a resistance corresponding to the characteristic impedance of the line at the vacuum end of 23' of the feedthrough with the barrier 51 in place and adjusting the axial position of barrier 53 to obtain the proper position for minimum VSWR measured from the higher pressure end 19' when a signal corresponding to the designed operating frequency is applied from a line coupled to the end 19'. Once the proper position for the barriers is determined, they are each installed using the radial force sealing arrangement as described above for the single barrier embodiment.

First, a sleeve 55 is pressed onto a radial force transmitting collar 57 located in proper axial alignment with the first barrier element 51 on the outside of the flange extension 35'. The sleeve 55 and collar 57 are tapered at an angle of between 3 and 5 degrees (shown exaggerated in Fig. 2 for illustration purposes) along the mating surfaces 59 so that the radial force is evenly distributed over the outer surface of the collar 57 and thus to the outer surface of the barrier 51. Once the other sleeve is pressed on, an inner plug 61 is pressed into a radial force transmitting collar 63 on the inside diameter of the coupling extension 37' axially aligned with the barrier 51. The mating surfaces of the plug 61 and collar 63 are also tapered as shown at 65 to distribute the sealing force.

After the barrier 51 is sealed, a first steel reinforcing cylinder 67 is inserted over the outer surface of the outer conductor copper tube 13' which butts against the end of the extension 35' of the flange 25'. A second steel reinforcing cylinder 69 is inserted inside the inner conductor copper tube 11' which butts against the end of the reinforcing extension 37' of coupling 29'. These reinforcing cylinders are cut to also act as spacers for the location of radial force transmitting collars 71 and 73 which are inserted to butt against the ends of cylinders 67 and 69, respectively, in proper alignment with the second barrier disk 53.

Once the collars 71 and 73 are in place, a sleeve 75 is pressed over the collar 71 and a plug 77 is pressed into collar 73 to seal the second barrier disk 53 in place within the feedthrough in the same manner as described above for barrier disk 51. The reinforcing cylinders 67 and 69 prevent buckling of the soft copper tubes forming the conductors 13' and 11', respectively, during the process of pressing the sleeve 75 and plug 77 into position. After the barrier disks 51 and 53 are sealed into position, the end flange 21' is installed on the outer conductor tube 13' to form a smooth continuous outer conductor wall of the coaxial transmission line. As in the single barrier embodiment of FIG. 1, each of the radial force transmitting collars of the dual barrier disk embodiment of FIG. 2 are slightly thinner axially than the barrier disks 51 and 53 to prevent distortion of the inner and outer conductor radii, thereby preventing unwanted electric field enhancement at the faces of the barriers as explained above.

In selecting the barrier thickness in the dual barrier feedthrough embodiment, a trade-off can be made, depending on the application, between the use of thicker ceramic barrier disks for maximum structural strength and reduced overall length of the feedthrough or thinner disks which are lighter and could be easily face cooled by passing a cooling gas or other cooling fluids (not shown) through the coaxial line in the area between the disks 51 and 53. For face cooled ceramics the dielectric constant of the coolant must be accounted for in determining the barrier disk spacing.

In the embodiment shown in FIG. 2 for an operating frequency of 425 MHz, the barrier disk widths (b) were selected to be 1 cm and a VSWR ratio of one is achieved for a spacing (d) of $0.185\lambda = 13.06$ cm. The overall length of this dual barrier arrangement is then 15.06 cm which is less than 3 cm longer than the single barrier embodiment of FIG. 1.

Thus, it will be seen that an improved coaxial transmission line feedthrough has been provided based on the use of single or multiple dielectrics which produce an overall phase shift of 180% to achieve perfect transparency to RF power wherein the inner and outer conductors are sealed in a gas-tight sealing arrangement against the conductor walls without changing the shape or radii of the conductors in the vicinity of the dielectric barriers so that the electric field is continuous across the dielectric faces. This leads to a feedthrough having higher power handling potential and capability of operating at higher temperatures.

Although the invention has been illustrated by means of two specific embodiments, it will be obvious to those skilled in the art that various modifications and changes may be made therein without departing from the spirit and scope of the invention as set forth in the following claims attached to and forming a part of this specification.

I claim:

1. A radio frequency coaxial transmission line feedthrough device for transmitting radio frequency energy between first and second coaxial transmission line regions of different pressure, comprising:

a coaxial transmission line segment having an inner cylindrical conductor formed of an electrically conductive material and an outer cylindrical conductor formed of an electrically conductive material and coaxially disposed about and spaced from said inner conductor, said coaxial transmission line segment being adapted for connection between said first and second coaxial transmission line regions;

a least one pressure barrier means for sealably isolating said first and second coaxial transmission line regions and providing transmission of said radio frequency energy therethrough, including an annular right circular cylinder barrier disk formed of a rigid, impermeable, electrically insulating material coaxially disposed between and contiguous with said inner and outer conductors of said segment along the length thereof; a first radial force transmitting collar disposed about and contiguous with the outer surface of said outer conductor in axial alignment with said barrier disk; a sleeve formed of a material having a coefficient of expansion equal to or less than said barrier disk disposed about said first radial force transmitting collar to continually generate a radially inward force sufficient to form a gas-tight seal between the inner surface of said outer conductor and the outer diameter surface of said barrier disk; a second radial force transmitting collar disposed within and contiguous with the inner surface of said inner conductor in axial alignment with said barrier disk and a plug formed of a material having a coefficient of expansion equal to or greater than said barrier disk disposed within said second radial force transmitting collar to continually generate a radially outward force sufficient to form a gas-tight seal between the outer surface of said inner conductor and the inner diameter surface of said barrier disk, said first and second radial force transmitting collars having an axial thickness less than that of said barrier disk of an amount sufficient to prevent deformation of the radii of said outer and inner conductors at the edges of said barrier disk from the application of said inner and outer radial forces transmitted through said first and second radial force transmitting collars to the walls of said outer and inner conductors, respectively.

2. A feedthrough as set forth in claim 1 wherein the mating surfaces of said first force transmitting collar and said sleeve and the mating surfaces of said second force transmitting collar and said plug are uniformly tapered at an angle of between 3 and 5 degrees to uniformly distribute the corresponding radial sealing forces transmitted therethrough to the corresponding surfaces of said barrier.

3. A feedthrough as set forth in claim 2 wherein said at least one pressure barrier means includes a single pressure barrier means and wherein said barrier disk has an axial thickness equal to one-half wavelength of the transmitted radio frequency energy wavelength in the medium forming said barrier disk to prevent reflections of said radio frequency energy being transmitted through said coaxial transmission line segment.

4. A feedthrough as set forth in claim 3 wherein said inner and outer conductors are formed of copper and said barrier disk is formed of alumina.

5. A feedthrough as set forth in claim 2 wherein said at least one pressure barrier means includes first and second pressure barrier means disposed apart axially along said coaxial transmission line segment a sufficient distance to provide cancellation of reflections of said radio frequency energy being transmitted therethrough from the barrier disk of one of said first and second pressure barrier means by the barrier disk of the other of said first and second pressure barrier means, and wherein said barrier disk of each of said first and second pressure barrier means has an axial thickness substantially less than one-half wavelength of the transmitted radio frequency energy wavelength in the medium forming said barrier disk.

* * * * *